US005920746A

United States Patent [19]

Thomas et al.

[11] Patent Number: 5,920,746

[45] Date of Patent: Jul. 6, 1999

[54] TRANSFER APPARATUS

[75] Inventors: Dean Thomas, Webster; Robert A. Gross, Penfield, both of N.Y.

[73] Assignee: Xerox Corporation, Stamford, Conn.

[21] Appl. No.: 09/138,751

[22] Filed: Aug. 24, 1998

[51] Int. Cl.[6] ..... G03G 15/16

[52] U.S. Cl. ..... 399/45; 399/66; 399/316

[58] Field of Search ..... 399/45, 66, 316, 399/388

[56] References Cited

U.S. PATENT DOCUMENTS 5,311,267 5/1994 Bean ..... 355/271

5,678,122 10/1997 Gross ..... 399/16

*Primary Examiner*—Joan Pendegrass

*Attorney, Agent, or Firm*—H. Fleischer; J. E. Beck

[57] ABSTRACT

An apparatus which transfers a developed image from a photoconductive member to a sheet. A sheet baffle guides an advancing sheet to the photoconductive member at the transfer station. The sheet baffle has an elongated axis extending in a transverse direction to the planer surface of the photoconductive member. A sensing unit, located prior to the transfer station, generates a signal indicative of the sheet basis weight. A regulator, responsive to the signal from the sensing unit, adjusts the position of the sheet baffle to position the elongated axis thereof at a selected angle relative to the planer surface of the photoconductive member. This angle is greater for a lightweight sheet than for a heavyweight sheet.

10 Claims, 2 Drawing Sheets

TRANSFER APPARATUS

Figure 1:
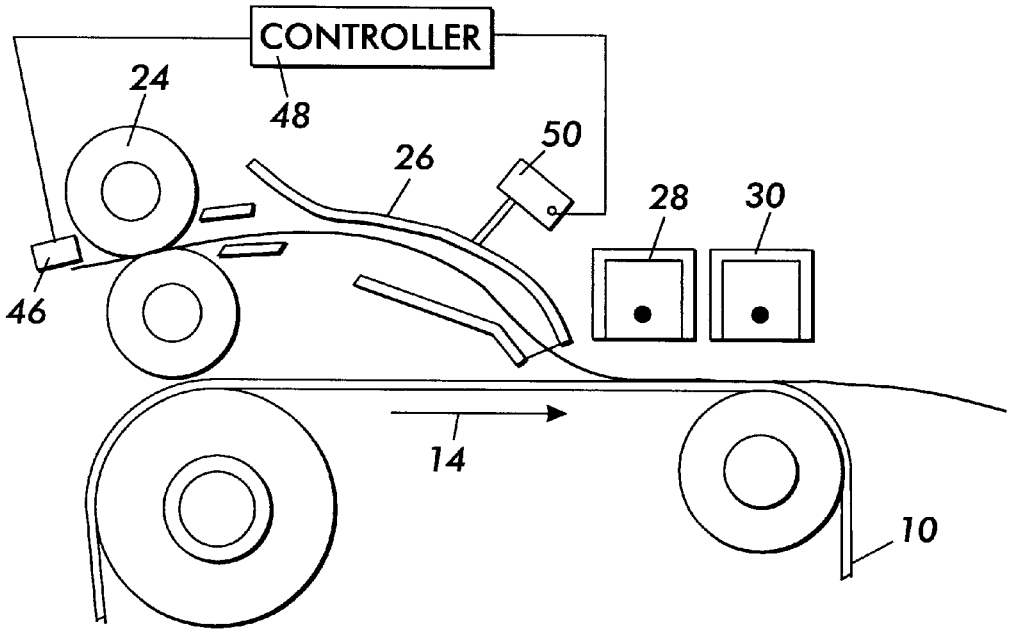

This invention relates generally to an electrophotographic printing machine, and more particularly, concerns an apparatus for transferring a developed image from a photoconductive surface to a sheet.

A typical electrophotographic printing machine employs a photoconductive member that is charged to a substantially uniform potential so as to sensitize the surface thereof. The charged portion of the photoconductive surface is exposed to a light image. Exposure of the charged photoconductive surface selectively dissipates the charge thereon in the irradiated areas to record an electrostatic latent image on the photoconductive surface corresponding to the informational areas being reproduced by the printing machine. After the electrostatic latent image is recorded on the photoconductive surface, the latent image is developed by bringing a developer material into contact therewith. Generally, the electrostatic latent image is developed with dry developer material having carrier granules with toner particles adhering thereto. However, a liquid developer material may be used as well. The toner particles are attracted to the latent image forming a visible image on the photoconductive surface. After the electrostatic latent image is developed with the toner, the toner image is transferred to a sheet. The toner image is then heated to permanently fuse it to the sheet.

High speed commercial printing machines of the foregoing type handle a wide range of differing weight sheets. The beam strength of the sheet is a function of the weight of the sheet. Heavy weight sheets have greater beam strength than lighter weight sheets. Inasmuch as the sheet conveying system of the printing machine handles a wide range of differing weight sheets, it is not unusual for the sheet to be cockled before it is transported to the processing station where the developed image is transferred to the sheet. The stack of sheets placed in the sheet feeder may be initially cockled, or the sheets may become cockled as they are fed from the stack to the transfer station. At the transfer station, the sheet adheres to the photoconductive member. In the event the sheet is cockled, it is not held in intimate contact with the photoconductive surface, but rather spaces occur between the developed image on the photoconductive surface and the sheet. In the electrostatic transfer of the toner image to the sheet, it is necessary for the sheet to be in uniform, intimate contact with the toner powder image developed on the photoconductive surface. Failure to do so results in variable transfer efficiency and, in the extreme, areas of low or no transfer resulting in image deletions. Pretransfer sheet guides can be used to put an "S" bend in the sheet. This "S" bend will force the paper flat against the photoconductive surface as it enters the transfer region. The higher the degree of the "S" bend, the more normal a flattening force can be achieved. However, optimal sheet entry angles for lightweight sheets is not necessarily optimal for heavyweight sheets. Various types of baffle arrangements have been employed heretofore. The following disclosures appear to be relevant:

U.S. Pat. No. 5,311,267 Patentee: Bean Issues: May 10, 1994

U.S. Pat. No. 5,678,122 Patentee: Gross Issued: Oct. 14, 1997

U.S. Pat. No. 5,311,267 discloses a combination of a roller and baffle used to impart a curvilinear or S-shape to the sheet. The baffle may be moved to vary the shape of the sheet as the sheet moves into the transfer zone.

U.S. Pat. No. 5,678,122 discloses a moveable baffle and a sheet basis weight sensing unit which detects the weight of the sheet. The signal from the sensing unit is sent to a controller which, in conjunction with an electromechanical device coupled thereto, moves the guide to provide the proper bend for the sheet.

In accordance with one aspect of the present invention, there is provided an apparatus for transferring a developed image from a photoconductive member having a generally planer surface to a sheet. The apparatus includes a sheet guide having an elongated axis extending in a transverse direction relative to the planer surface of the photoconductive member. A sensing unit, operatively associated with the sheet, generates a signal indicative of the sheet basis weight. A regulator, responsive to the signal from the sensing unit, adjusts the position of the sheet guide to position the elongated axis thereof at a selected angle relative to the planer surface of the photoconductive member. This angle is greater for a lightweight sheet than for a heavyweight sheet.

Pursuant to another aspect of the present invention, there is provided an electrophotographic printing machine of the type in which a developed image is transferred from a photoconductive member having a generally planer surface to a sheet. The printing machine includes a sheet guide having an elongated axis extending in a transverse direction relative to the planer surface of the photoconductive member. A sensing unit, operably associated with the sheet, generates a signal indicative of the sheet basis weight. A regulator, responsive to the signal from the sensing unit, adjusts the position of the sheet guide to position the elongated axis thereof at a selected angle relative to the planer surface of the photoconductive member. This angle is greater for a lightweight sheet than for a heavyweight sheet.

Figure 2:
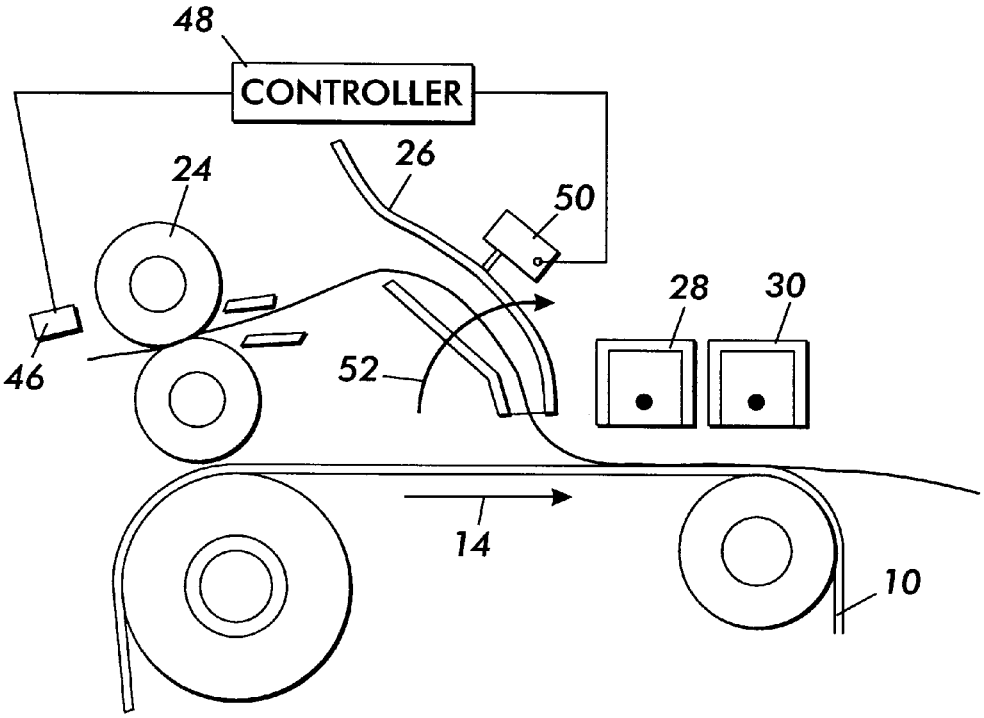
Figure 3:
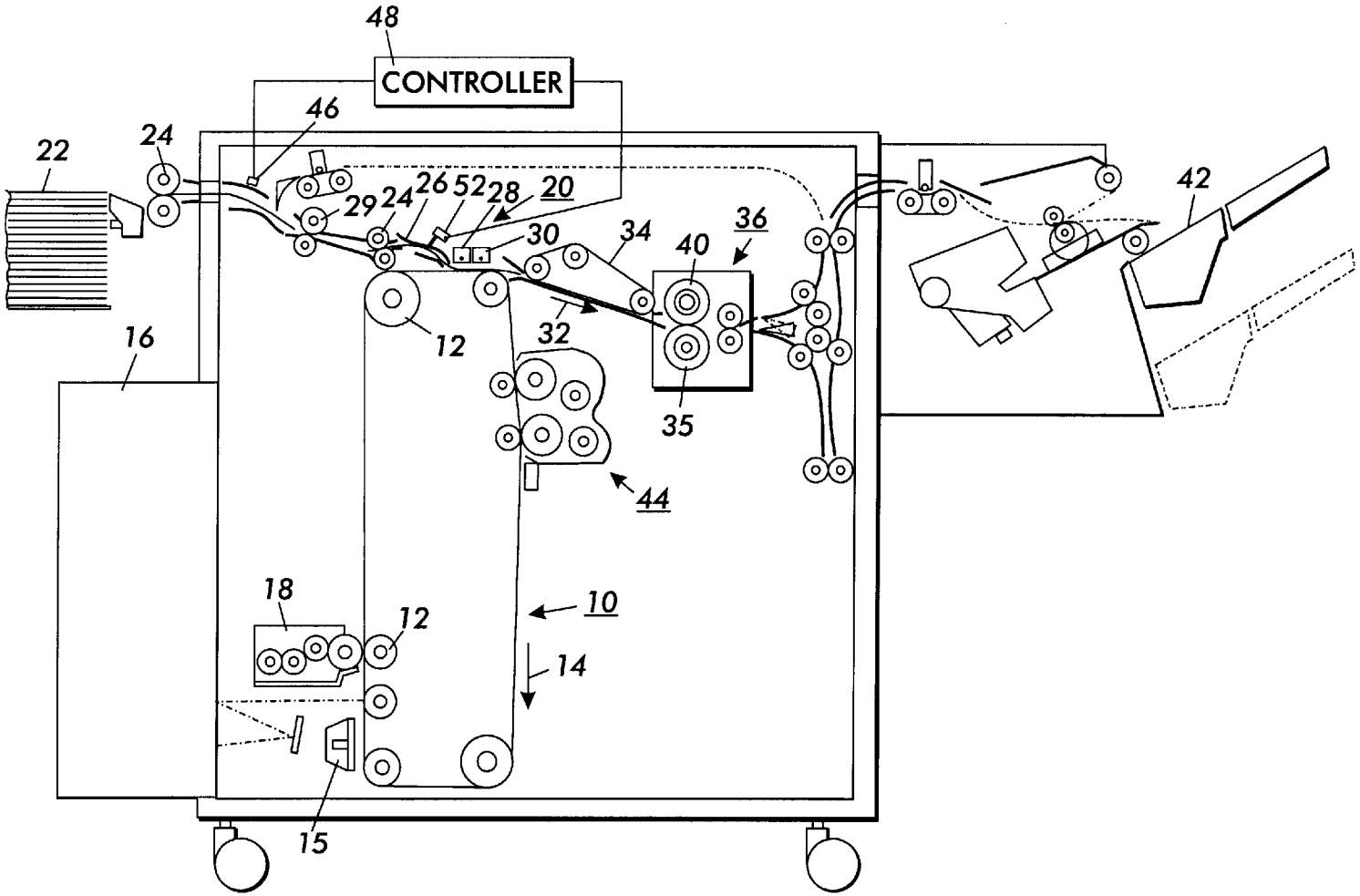

Other aspects of the present invention will become apparent as the following description proceeds and upon reference to the drawings, in which:

FIG. 1 is an elevational view showing the transfer station with the sheet baffle positioned to handle a heavyweight sheet; and FIG. 2 is an elevational view showing the transfer station with the sheet baffle positioned to handle a lightweight sheet; and FIG. 3 is a schematic elevational view depicting an illustrative electrophotographic printing machine incorporating the apparatus of the present invention therein.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring initially to FIG. 3, there is shown an electrophotographic printing machine having the transfer apparatus of the present invention therein. The printing machine employs a photoconductive belt 10 supported by a plurality of rollers or bars 12. Photoconductive belt 10 is arranged in a vertical orientation and advances in the direction of arrow 14. Successive portions of the photoconductive surface of belt 10 advance sequentially to the various processing stations disposed about the path of movement thereof.

Initially, belt 10 passes through charging station 15. At the charging station, a corona generating device charges the photoconductive surface of belt 10 to a relatively high, substantially uniform potential. After the photoconductive surface of belt 10 is charged, the charged portion thereof is advanced to the exposure station.

At the exposure station, an imaging beam generated by a raster output scanner (ROS) 16 creates an electrostatic lightened image on the photoconductive surface of belt 10. One skilled in the art will appreciate that a laser diode ray may be used as well. This electrostatic latent image is developed by developer unit 18.

Developer unit 18 deposits toner particles on the electrostatic latent image. In this way, a toner powder image is formed on the photoconductive surface of belt 10. After the toner powder image has been developed on the photoconductive surface of belt 10, belt 10 continues to advance in the direction of arrow 14 to transfer station 20.

At transfer station 20, a sheet of support material, e.g. paper, is advanced from stack 22 by a sheet feeding apparatus. The topmost sheet is advanced by forwarding rollers 24 to transfer station 20. At transfer station 24, guide baffle 26 is positioned to guide the leading edge of the sheet so as to be tacked to belt 10 in registration with the developed toner powder image thereon. The sheet, in contact with the toner powder image on belt 10, is advanced with belt 10 in the direction of arrow 14 to corona generator 28. Corona generator 28 sprays ions onto the backside of the sheet to effectuate the transfer of the toner powder image from belt 10 to the sheet. The sheet is maintained against belt 10 during the transfer process and eventually the lead edge of the sheet reaches, or is advanced beneath corona generator 30. As the belt proceeds around roller 32, the sheet, now having the toner powder image deposited thereon, proceeds in the direction of arrow 32 on vacuum transport 34. Vacuum transport 34 moves the sheet in the direction of arrow 32 to fusing station 36.

Fusing station 36 includes a fuser roller 38 and a backup roll 40. The backup roll 40 is resiliently urged into engagement with fuser roll 38 to form a nip through which the sheet passes. In the fusing operation, the toner particles coalesce with one another and bond to the sheet in image configuration forming an image thereon. After fusing, the finished sheet is discharged to catch tray 42.

Invariably, after the toner powder image has been transferred to the sheet, residual toner particles remain adhering to the photoconductive surface of belt 10. These residual toner particles are removed therefrom at cleaning station 44. After cleaning the photoconductive surface of belt 10, the cycle is repeated for the next successive print.

Guide baffle 26 is moveable. The baffle moves in response to the detected sheet weight basis. The elongated axis of the sheet baffle is positioned relative to the planer surface of belt 10. This angle is greater for lightweight sheets than for heavyweight sheets. As the sheet moves from stack 22 to transfer station 20, sheet basis weight sensor 46 measures the basis weight of the sheet and sends a signal to a controller 48 which actuates a solenoid 50 to position guide baffle 26 at the selected orientation such that the selected angle of guide baffle relative to the planer surface of belt 10 is optimized for the weight of the sheet advancing to the transfer station. One type of suitable sheet basis weight sensor is described in U.S. Pat. No. 5,138,178 issued to Wong et al., Aug. 11, 1992, the relevant portions thereof being hereby incorporated into the present application.

Referring now to FIG. 1, there is shown the details of transfer station 20. Guide baffles 26 are designed to put an S-bend in the sheet. The S-bend will force the sheet flat against belt 10 as it enters the transfer region. The problem arises in that with higher normal forces, the amount of drag through the baffles increases. This becomes a problem after the trail edge of the sheet leaves the registration nip and is no longer being driven. If the drag becomes too high, the tacking of the sheet to belt 10 may not be sufficient to permit belt 10 to pull the sheet from the baffles, this will result in a smear or disturbance of the image being transferred to the sheet. Testing has shown that the primary contributor to the increase in normal force is the angle of guide baffles 26 or the angle of the tack of the sheet to belt 10. It has been found that the drag force may be reduced by pivoting guide baffle 26 so as to increase the normal force when a lightweight sheet is being used and to decrease the normal force when a heavyweight sheet is being used. FIG. 1 depicts guide baffles 26 in a position such that the angle between the elongated axis thereof and the planer surface of belt 10 is optimized for heavyweight paper. In this way, the tacking force or pulling force between belt 10 and the sheet is sufficient to enable the sheet to be dragged through the guide baffles without introducing any smear of the image. It has been found that by maintaining the angle between the elongated axis of guide baffle 26 and the planer surface of belt 10 at about 30°, heavyweight sheets may be employed without producing smear or drag of the image being transferred thereto. This orientation is shown in FIG. 1. Thus, in operation, sheet basis weight sensing unit 46 detects the basis weight of the sheet being advanced to transfer station 20. Sheet basis weight sensing unit 46 transmits a signal to controller 48. Controller 48, in turn, actuates an electromechanical device such as solenoid 50 which is coupled to guide baffle 26. Guide baffle 26 is mounted pivotably on the printing machine frame. Solenoid 50 pivots guide baffle 26 so as to position the elongated axis thereof at about 30° relative to the planer surface of belt 10 when a heavyweight sheet is being advanced to transfer station 20.

Referring now to FIG. 2, there is shown guide baffle 26 pivoted so as to position the elongated axis thereof at an angle of about 45 degrees with respect to the planer surface of belt 10. In this orientation, lightweight sheets are being advanced to transfer station 20. Thus, sheet basis weight sensor 46 has detected a lightweight sheet being advanced to transfer station 20. A signal is transmitted to controller 48 from sheet basis weight sensor 46 which indicates that such a lightweight sheet is being advanced. Controller 48 actuates solenoid 50 to pivot guide baffle 26 in a clockwise direction as indicated by arrow 52. In this way, the elongated axis of guide baffle 26 is set to an angle of about 45 degrees with respect to the generally planer surface of belt 10. In this orientation, the normal force on the lightweight paper is increased and the lightweight sheet is flattened against belt 10 as it advances beneath corona generating device 28. Thus, there are no voids or spaces between the sheet and the photoconductive surface having the toner powder image thereon. This prevents image deletions.

In recapitulation, it is clear that the present invention is directed to a transfer apparatus wherein the baffle guiding the sheet is pivotably moveable as a function of the detected sheet weight basis. The angle between the elongated axis of the guide baffle and the planer surface of the photoconductive member is greater for a lightweight sheet than for a heavyweight sheet. This insures that the drag force is maintained at a level such that the sheet moves in unison with the photoconductive belt to prevent smears or distortions of the image. In addition, this insures that the normal force is optimized to flatten the sheet against the photoconductive surface having the toner powder image thereon during the transfer process so as to minimize image deletions.

It is, therefore, apparent that there has been provided in accordance with the present invention, a transfer apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for transferring a developed image from a photoconductive member having a generally planer surface to a sheet, including:

a sheet guide having an elongated axis extending in a transverse direction to the planer surface of the photoconductive member;

a sensing unit, operably associated with the sheet, to generate a signal indicative of the sheet basis weight; and a regulator, responsive to the signal from said sensing unit, for adjusting the position of said sheet guide to position the elongated axis thereof at a selected angle relative to the planer surface of the photoconductive member wherein the angle is greater for a lightweight sheet than for a heavyweight sheet.

2. An apparatus for transferring a developed image from a photoconductive member having a generally planar surface to a sheet, including:

a sheet guide having an elongated axis extending in a transverse direction to the planar surface of the photoconductive member;

a sensing unit, operably associated with the sheet guide to generate a signal indicative of the sheet basis weight; and a regulator, responsive to the signal from said sensing unit, for adjusting the position of said sheet guide to position the elongated axis thereof at a selected angle relative to the planar surface of the photoconductive member, wherein the angle is greater for a lightweight sheet than for a heavyweight sheet, wherein the angle between the elongated axis of said sheet guide and the planar surface of the photoconductive member ranges from about 30° for a heavy weight sheet to about 45° for a light weight sheet.

3. An apparatus for transferring a developed image from a photoconductive member having a generally planar surface to a sheet, including:

a sheet guide having an elongated axis extending in a transverse direction to the planar surface of the photoconductive member, said sheet guide includes a generally planer member and a curvilinear member spaced from said planar member, to define a sheet path therebetween, for bending the sheet moving through the sheet path;

a sensing unit, operatively associated with the sheet, to generate a signal indicative of the sheet basis weight; and a regulator, responsive to the signal from said sensing unit, for adjusting the position of said sheet guide to position the elongated axis thereof at a selected angle relative to the planar surface of the photoconductive member, wherein the angle is greater for a lightweight sheet than for a heavyweight sheet.

4. An apparatus according to claim 3, further including a charging element, positioned adjacent said sheet guide, to charge the sheet exiting the sheet path for establishing a transfer field that is effective to attract the developed image from the photoconductive member to the sheet.

5. An apparatus according to claim 4, wherein said regulator includes:

a controller adapted to receive the signal from said sensing unit and transmitting an actuation signal in response thereto; and an actuator moveably supporting said sheet guide, said actuator being in communication with said controller and being adapted to move said sheet guide as a function of the actuation signal from said controller.

6. An electrophotographic printing machine of the type in which a developed image is transferred from a photoconductive member having a generally planer surface to a sheet, including:

a sheet guide having an elongated axis extending in a transverse direction to the planer surface of the photoconductive member;

a sensing unit, operably associated with the sheet, to generate a signal indicative of the sheet basis weight; and a regulator, responsive to the signal from said sensing unit, for adjusting the position of said sheet guide to position the elongated axis thereof at a selected angle relative to the planer surface of the photoconductive member wherein the angle is greater for a lightweight sheet than for a heavyweight sheet.

7. An electrophotographic printing machine of the type in which a developed image is transferred from a photoconductive member having a generally planar surface to a sheet, including:

a sheet guide having an elongated axis extending in a transverse direction to the planar surface of the photoconductive member;

a sensing unit, operably associated with the sheet, to generate a signal indicative of the sheet basis weight; and a regulator, responsive to the signal from said sensing unit, for adjusting the position of said sheet guide to position the elongated axis thereof at a selected angle relative to the planar surface of the photoconductive member, wherein the angle is greater for a lightweight sheet than for a heavyweight sheet, wherein the angle between the elongated axis of said sheet guide and the planer surface of the photoconductive member ranges from about 30 degrees for a heavyweight sheet to about 45 degrees for a lightweight sheet.

8. An electrophotographic printing machine of the type in which a developed image is transferred from a photoconductive member having a general planar surface to a sheet, including:

a sheet guide having an elongated axis extending in a transverse direction to the planar surface of the photoconductive member, said sheet guide includes a generally planer member and a curvilinear member, spaced from said planer member to define a sheet path therebetween, for bending the sheet moving through the sheet path;

a sensing unit, operatively associated with the sheet, to generate a signal indicative of the sheet basis weight; and a regulator, responsive to the signal from said sensing unit, for adjusting the position of said sheet guide to position the elongated axis thereof at a selected angle relative to the planar surface of the photoconductive member, wherein the angle is greater for a lightweight sheet than for a heavyweight sheet.

9. A printing machine according to claim 8, further including a charging element positioned adjacent said sheet guide, to charge the sheet exiting the sheet path for establishing a transfer field that is effective to attract the developed image from the photoconductive member to the sheet.

10. A printing machine according to claim 9, wherein said regulator includes:

a controller adapted to receive the signal from said sensing unit and transmitting an actuation signal in response thereto; and an actuator moveably supporting said sheet guide, said actuator being in communication with said controller and being adapted to move said sheet guide as a function of the actuation signal from said controller.

* * * * *